United States Patent [19]

Arnold

[11] 4,154,179

[45] May 15, 1979

[54] AUTOMATIC BACK-TACK SYSTEM FOR INDUSTRIAL SEWING MACHINE

[75] Inventor: Bruce E. Arnold, Clinton, N.J.

[73] Assignee: The Singer Company, New York, N.Y.

[21] Appl. No.: 857,162

[22] Filed: Dec. 5, 1977

[51] Int. Cl.[2] ..... D05B 69/18; D05B 69/20

[52] U.S. Cl. ..... 112/317; 112/262.1

[58] Field of Search ..... 112/210, 277, 121.11, 112/262

[56] References Cited

U.S. PATENT DOCUMENTS

| | | | |
|---|---|---|---|
| 3,074,632 | 1/1963 | Braun et al. | 112/121.11 X |
| 3,363,594 | 1/1968 | Kosrow | 112/210 |
| 4,080,914 | 3/1978 | Ishida et al. | 112/277 |

*Primary Examiner*—Peter Nerbun

*Attorney, Agent, or Firm*—David L. Davis; Robert E. Smith; Edward L. Bell

[57] ABSTRACT

A high speed electronically controlled industrial sewing machine having an automatic back-tack capability is disclosed. To achieve balanced stitching in the first and last tacks of a seam while still operating at high speed, the stitches in the tacks are counted and additionally a fixed time delay is provided in the feed reversal command circuitry to compensate for system inertias which result in response time delays of the sewing machine to the feed reversal command signals.

9 Claims, 8 Drawing Figures

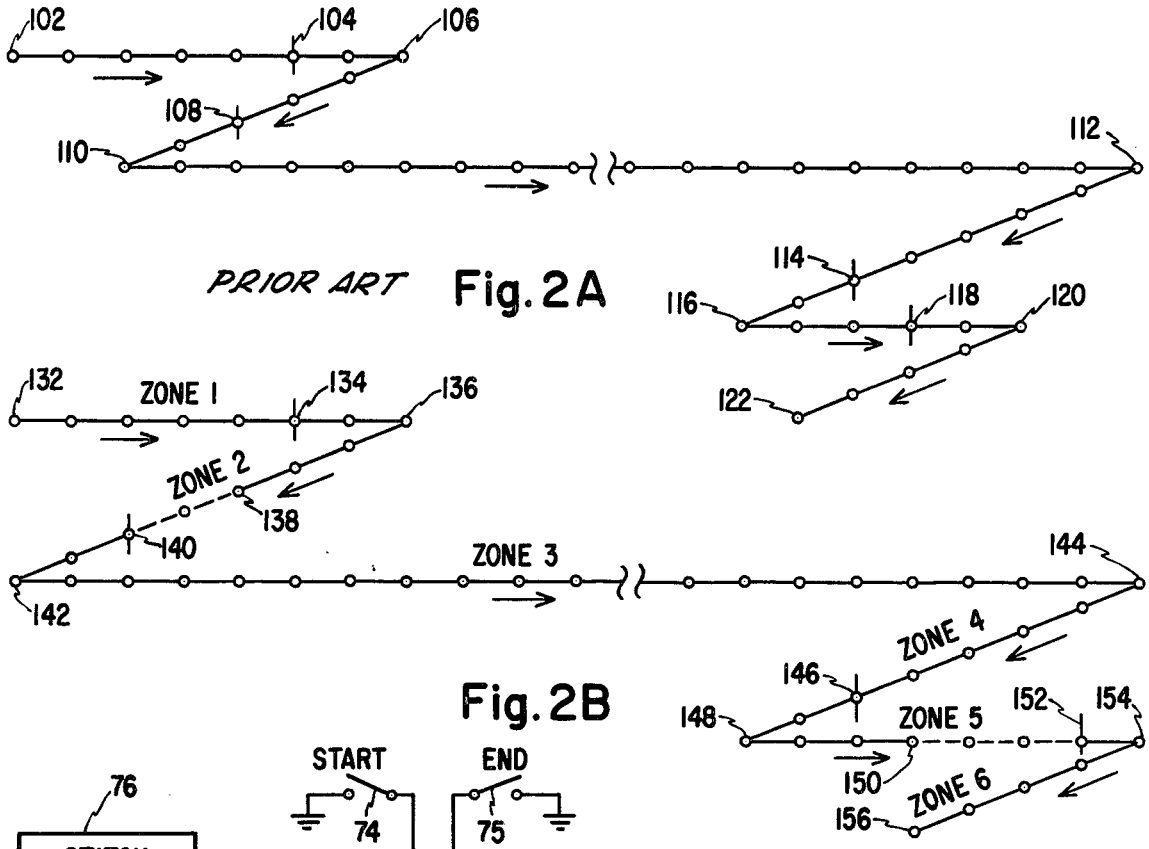
102
104
106
108
110
112
114
116
118
120
122
PRIOR ART
Fig. 2A
132
ZONE 1
134
136
ZONE 2
138
140
142
ZONE 3
144
ZONE 4
146
148
ZONE 5
152
154
150
ZONE 6
156
Fig. 2B
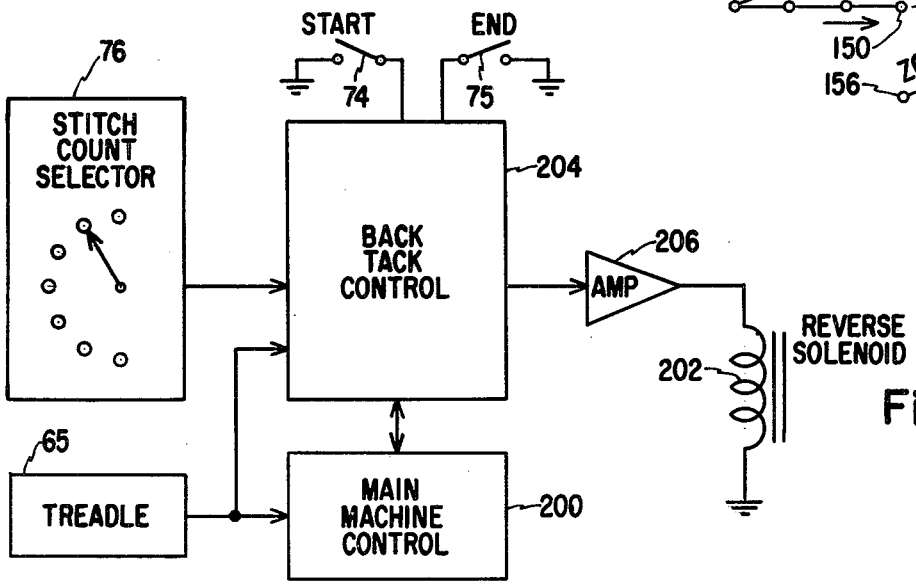
START
END
74
75
76
STITCH COUNT SELECTOR
204
BACK TACK CONTROL
206
AMP
REVERSE SOLENOID
202
65
TREADLE
MAIN MACHINE CONTROL
200
Fig. 3
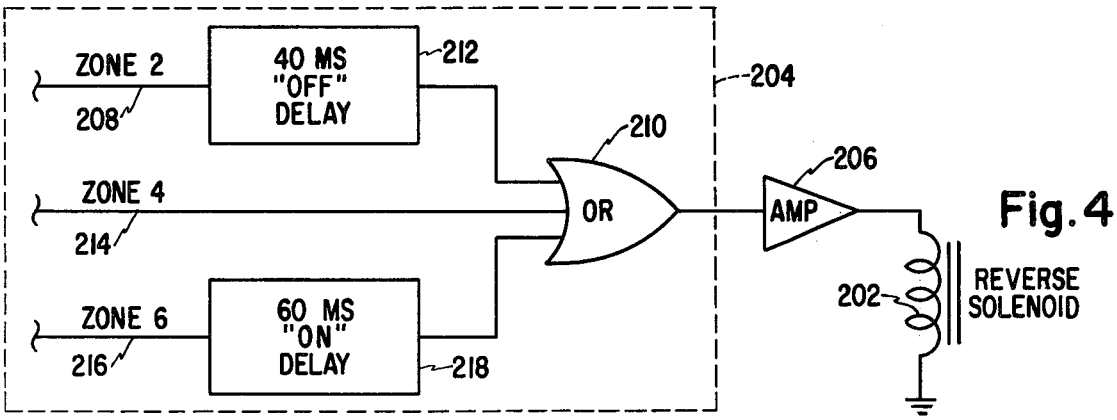
ZONE 2
208
40 MS "OFF" DELAY
212
204
210
ZONE 4
214
OR
206
AMP
ZONE 6
216
60 MS "ON" DELAY
218
202
REVERSE SOLENOID
Fig. 4

AUTOMATIC BACK-TACK SYSTEM FOR INDUSTRIAL SEWING MACHINE

BACKGROUND OF THE INVENTION

This invention relates to sewing machines and, more particularly, to a system for use in a high speed industrial sewing machine to provide balanced stitching in the back-tack mode at high speed.

When sewing a seam on a work piece, it is a common practice to provide locking stitches at the leading and trailing edges of the seam. For purposes of the following description, "back-tack" refers generally to the locking stitches at both the leading and trailing edges of the seam, "first tack" refers specifically to the locking stitches at the leading edge of the seam, and "last tack" refers specifically to the locking stitches at the trailing edge of the seam. The first tack is formed by providing a fixed number of stitches in the forward direction followed by the same number of stitches in the reverse direction. Thereafter, the seam is sewn to its end. The last tack is formed by sewing a fixed number of stitches in the reverse direction followed by the same number of stitches in the forward direction. Additionally, at the end of the last tack, a further number of stitches in the reverse direction may be sewn for a reverse trim operation. In the prior art, the back-tack operation in automatic sewing machines was typically performed by counting the number of stitches and providing feed reversal command signals after the appropriate number of stitches. While this technique may be satisfactory at low speeds of operation, as the sewing speed increases the system inertias and response delay times prevent the machine from instantaneously reversing, thereby creating an imbalance in the different directions of back-tack stitches.

It is therefore an object of the present invention to provide an automatic back-tack system for a high speed sewing machine.

It is a further object of this invention to provide such an automatic back-tack system wherein balanced back-tack stitching is attained.

SUMMARY OF THE INVENTION

The foregoing and additional objects of this invention are attained by providing an automatic back-tack system for a sewing machine having a sewing needle and a reversible work feed mechanism, the sewing needle and the work feed mechanism operating in synchronism to form stitches in a seam having a leading end and a trailing end in a work piece, stitches forming a back-tack being selectively sewn at at least one end of the seam, the back-tack stitches including a first portion formed by stitching in a first direction and a second portion formed by stitching in a second direction opposite the first direction, the back-tack system comprising means for generating a stitch signal in response to each penetration of the sewing needle, counting means responsive to the stitch signal for counting stitches within each back-tack portion and providing a count signal when the stitch count reaches a predetermined number, means responsive to the count signal for providing a reverse signal to reverse the work feed mechanism, and means for delaying the reverse signal a respective predetermined time interval at the end of each back-tack second position.

BRIEF DESCRIPTION OF THE DRAWING

The foregoing will be more readily apparent upon reading the following description in conjunction with the drawing in which:

FIG. 2A illustrates back-tack stitches formed at high speed wherein the back-tack operation is controlled by counting the stitches and FIG. 2B shows balanced back-tack stitching at high speed when utilizing the principles of this invention;

FIG. 3 depicts a block diagram of a back-tack control system embodying apparatus constructed in accordance with the principles of this invention;

FIG. 4 depicts a simplified logic schematic circuit diagram useful for explaining the principles of this invention;

GENERAL DESCRIPTION

Figure 1:
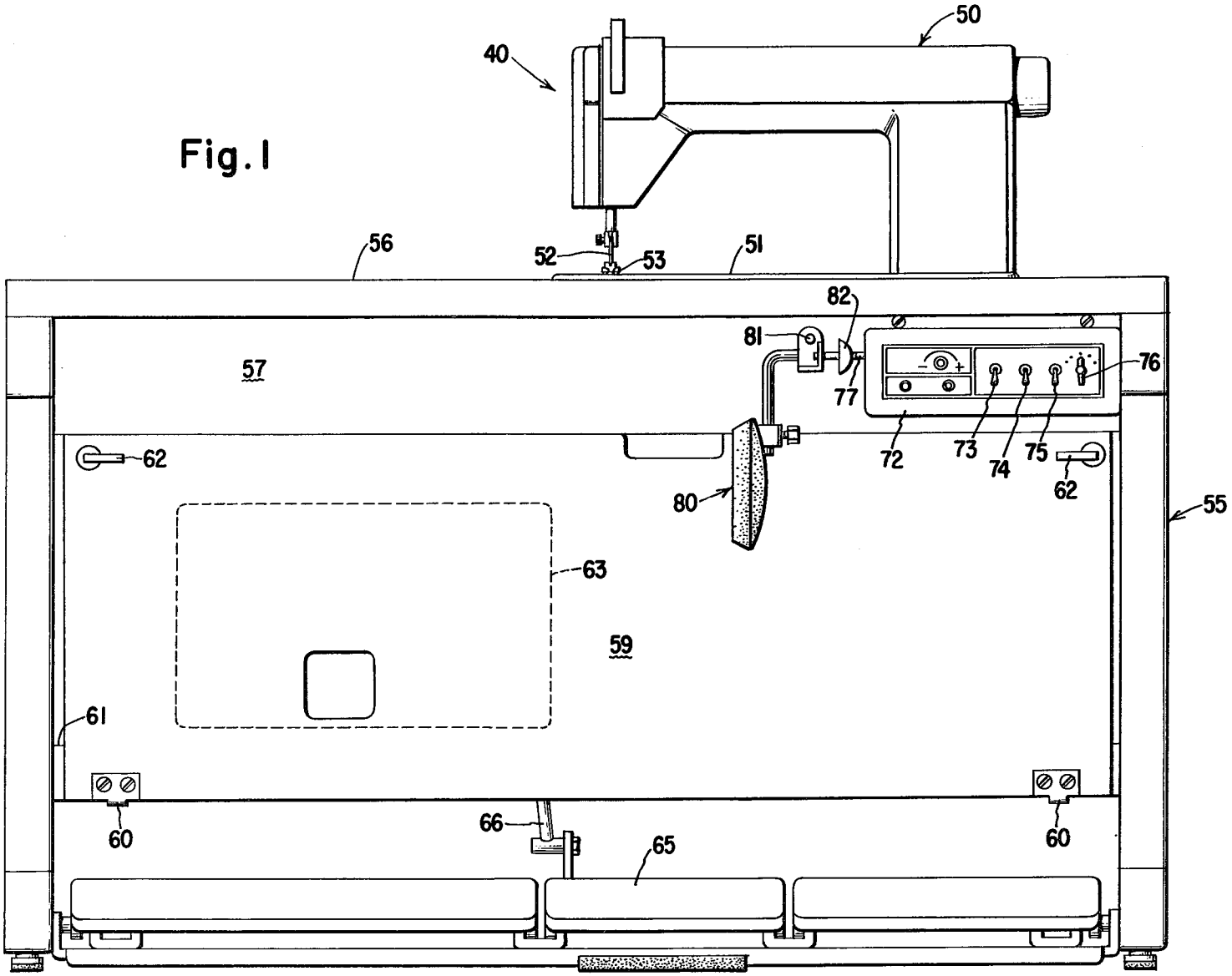
FIG. 1 is a front elevational view of a work table supported industrial sewing machine controllable by apparatus constructed in accordance with the principles of this invention.

Referring to FIG. 1, shown therein is an industrial sewing system designated generally by the reference numeral 40. The sewing system 40 includes a sewing machine 50 supported by a work table 55. A work supporting bed 51 of the sewing machine 50 is supported substantially co-planar with a work supporting top 56 of the work table 55. The sewing machine 50 includes a drive system (not shown) and may be pivotably supported in the work table 55 in a conventional manner. The drive system for the sewing machine 50 is supported beneath the sewing machine 50 behind a fixed front panel 57 of the work table 55 and is thereby concealed from view. Pivotably supported in the base of the work table 55 is a foot treadle 65, connected by a linkage 66 to electrical devices, such as switches and potentiometers, mounted on a sewing machine control box 63, which is supported within the work table 55 behind a hinged front panel 59, itself supported on hinges 60 affixed to cross-member 61 of the work table 55. The hinged front panel 59 is retained in a closed state by latches 62, which may be disengaged to rotate the front panel 59 downwardly, exposing the sewing machine control box 63.

Supported on the right side of the work table 55, beneath the work supporting top 56, is a small box 72 in which are mounted a main power switch 73, a START tack switch 74, an END tack switch 75, a tack stitch count selector switch 76, and a presser foot elevating switch 77. A knee shift device 80 is pivotally supported on a pivot bar 81 affixed to the fixed front panel 57. An abutment member 82 of the knee shift device 80 cooperates with the presser foot elevating switch 77 in order to effect elevation of the presser foot 53 of the sewing machine 50. As is well known in the art, the raising and lowering of the presser foot 53 may be pneumatically accomplished and controlled by a solenoid actuated valve which is activated by the presser foot elevating switch 77.

Operation of sewing system 40 to run a back-tack seam is accomplished through the selective operation of switches 74, 75 and 76, and treadle 65. START switch 74 and END switch 75 are two position switches. START switch 74 controls the first tack and END switch 75 controls the last tack. When it is desired that the seam have a first tack, START switch 74 is placed in a first position and, when it is desired that the seam not have a first tack, START switch 74 is placed in its second position. When it is desired that the seam have a last tack, END switch 75 is placed in a first position and, when it is desired that the seam not have a last tack, END switch 75 is placed in its second position. Selector switch 76 is illustratively a multiple position rotary switch which may be selectively positioned to program the desired number of stitches in the back-tacks. Proper indica are provided on the face of box 72 so that the number of stitches selected by the angular position of the rotary switch 76 is discernible by an operator. The foot treadle 65 is utilized to control the sewing system 40 in a conventional manner. When the treadle 65 is toed down, or rotated forward, sewing system 40 operates to form a seam. If the START switch 74 has been placed in its first position, the first tack is automatically formed. If the START switch 74 is in its second position, no first tack is formed. At the end of the seam, the operator heels, or rotates in a reverse direction, the treadle 65 to initiate a thread trimming function. If the END switch 75 is in its first position, this thread trimming function is preceded by a last tack operation. If the END switch 75 is in its second position, there is no last tack and only the thread trimming function is effected.

Sewing speed is controlled in a conventional manner by the circuitry disposed within control box 63. During the back-tack operation, a first speed reference is supplied to the motor drive servo. Illustratively, the sewing machine drive motor (not shown) is driven at 3000 rpm during the back-tack operation. During the running portion of the seam, the speed is controlled by the relative depression of the treadle 65. Illustratively, this speed will be at its maximum approximately 5000 or 6000 rpm. During the trimming operation, the speed is controlled to illustratively 400 rpm. As the manner of controlling the sewing machine speed does not form a part of the present invention, and since such control is conventional in the art, no further description thereof will be given herein.

Although not shown in FIG. 1, the sewing machine 40 depicted therein also includes a work feeding mechanism beneath the work supporting bed 51. The work feeding mechanism operates in synchronism with the sewing needle 52 so as to form stitches in a work piece held beneath the presser foot 53. The direction in which the work feed mechanism moves the work piece is controlled by the selective energization or deenergization of a solenoid referred to as the "reverse" solenoid. It is the control of this particular solenoid during the automatic back-tack mode of operation with which the present invention is concerned.

Referring now to FIG. 2A, shown therein is an illustrative stitch pattern for a seam having first and last tacks formed by the prior art method of counting stitches. In the pattern shown in FIG. 2A, needle penetrations are illustrated as open circles and the intervening areas by straight lines. Further, the arrows show the direction of feed, with arrows pointing toward the right being representative of forward feed and arrows pointing toward the left indicating reverse feed. Although the reverse feed portions of the pattern in FIG. 2A are shown as being at an angle with respect to the forward feed portions, it is understood that all feeding is colinear, the reverse feed being shown at an angle for reasons of clarity of illustration.

For purposes of illustration, the desired back-tack stitch count is chosen to be five stitches. Beginning at the point 102, five stitches are sewn in the forward direction until reaching the point 104. At the point 104, a command is given to reverse the direction of feed. However, the sewing machine has certain inherent inertial delays, such as for example, electro-pneumatic and electro-mechanical delays in operating the control elements as well as mechanical delays in moving the appropriate linkages. These delays cause the machine to continue feeding the work piece in the forward direction for a number of stitches, illustratively two, to the point 106 at which time the work feed mechanism actually reverses. Stitching in the reverse direction then proceeds until the point 108, at which time five stitches of reverse feeding have been counted. It is noted that although the machine has counted five reverse stitches, in actuality two of the stitches (from the point 104 to the point 106) have been in the forward direction and only three have been in the reverse direction. At the point 108, another command is given to return the feed to the forward direction. Again, certain inherent inertial delays delay the actual feed reversal and cause the stitching to continue in the reverse direction to the point 110 before the feed direction is actually changed. The seam is then sewn in the forward direction from the point 110 to its end at the point 112, at which time the machine would typically be brought to a stop. At this time the last tack operation is performed, starting with reverse stitching for five stitches to the point 114. At the point 114, the feed reversal command is given. However, due to the inherent inertial delays, additional stitches; for instance two more stitches in the reverse direction to the point 116 occur before feed reversal actually is effected. At the point 118, the system has counted five stitches which should have been in the forward direction, although only three have, and at this point either the machine is stopped or a reverse trim command is given. In this latter case, another few stitches in the forward direction to the point 120 will occur before the feed actually reverses for the reverse trim, illustratively completed at the point 122.

It is thus seen that an imbalance of stitching occurs with the points 102 and 110 being separated and similarly the points 112 and 120 being separated. It would be desirable to have these points matched up for purposes of uniformity and maximum seam strength. One way of accomplishing that objective is to slow down the back-tack operation. For illustrative purposes, a two stitch overrun before feed reversal occurs has been shown. However, this overrun varies according to the speed of the sewing machine. For exammple, it has been found that the system inertial delays are approximately 40 milliseconds. At a sewing speed of 3000 rpm, a 40 millisecond delay is equivalent to two stitches. At a speed of 500 rpm, the overrun would drop to one-third of a stitch. Thus, at a relatively low speed a uniform back-tack may be achieved. However, since the running seam from the points 110 to 112 is performed at speeds in the range of 5000 rpm or greater, it would be desirable if a uniform back-tack could be achieved at speeds on the order of 3000 rpm.

Referring now to FIG. 2B, shown therein is a seam stitch pattern in accordance with the principles of this invention wherein a uniform back-tack is achieved even at the higher speeds. Specifically, in accordance with the principles of this invention, the seam pattern starts at the point 132 and a number of stitches, illustratively five, are counted up to the point 134. The region from the point 132 to the point 134 will be referred to hereinafter as ZONE 1. At the point 134 the reverse command is given and after two more stitches in the forward direction due to system inertia, at the point 136 the feed reversal actually occurs. After five stitches have been counted, at the point 138 a delay is added before the feed reversal command is actually given at the point 140. The delay period is shown in FIG. 2B as dashed lines and the region from the point 134 to the point 140 will be referred to hereinafter as ZONE 2. At the point 140, the feed reversal command is again given. Then after a delay due to system inertia, the feed reversal actually occurs at the point 142. The seam is then stitched until the point 144 where the machine is stopped. The region from the point 140 to the point 144 will be referred to hereinafter as ZONE 3. At the point 144, the last tack is formed by reversing the feed and counting five stitches to the point 146. The region from the point 144 to the point 146 will be referred to hereinafter as ZONE 4. At the point 146 the feed reversal command is given. However, the actual feed reverse does not occur until the point 148. After five stitches, at the point 150 a delay is inserted and the feed reversal command is actually given at the point 152. The stitching during the delay is indicated by the dashed lines and the region from the point 146 to the point 152 will be referred to hereinafter as ZONE 5. At the point 152 the feed reversal command is given for the reverse trim operation, the actual feed reversal occurring at the point 154 due to system inertia. The reverse trim is completed at the point 156. The region from the point 152 to the point 156 will be referred to hereinafter as ZONE 6. It is noted that a uniform first tack and a uniform last tack are achieved by adding the delays in ZONES 2 and 5.

In accordance with a preferred embodiment of this invention, the delay time in ZONE 2 is chosen to be 40 milliseconds and the delay time in ZONE 5 is chosen to be 60 milliseconds. The reason for the differences in the delay periods for the first tack and the last tack is because the sequence of operations in the first tack and the last tack are different. In particular, at the end of the first tack, when going into ZONE 3, the sewing machine speed is accelerating up to 5000 rpm. After the point 150, the sewing machine is decelerating down to 400 rpm for the trim operation. It should be noted at this point that while fixed delays are shown, the number of stitches that actually occurs during the delays in ZONES 2 and 5 will vary depending upon the back-tack speed. When the speed is greater, the number of stitches is greater. However, the delays have been chosen to be approximately equal to the system inertia delays so that the stitch overruns due to the inertia delays will be compensated for by the delays, independent of the speed.

Referring now to FIG. 3, depicted therein is an overall block diagram of the system for controlling the "reverse" solenoid. The main machine control circuit 200 contains the logic and timing for controlling the machine operation, including its speed, the presser foot, the trimmer, and the needle position. It will be recalled that the particular environment described herein is an industrial sewing machine adapted for high speed straight stitching. Therefore, the only time that reverse stitching is necessary is during the back-tack and trim operations. Thus, the feed reverse solenoid 202 is controlled by a signal from the back-tack control circuit 204 through the amplifier 206. The back-tack control circuit 204 receives as its input timing signals from the main machine control circuit 200, sew and trim signals from the treadle 65, signals from the START switch 74 and the END switch 75 as to whether a first and/or last tack is desired, and an indication from the stitch count selector switch 76 as to the number of stitches desired in each portion of the back-tack. The back-tack control circuit 204 operates in the manner described previously, as will be described in greater detail hereinafter, to control the selective energization and deenergization of the reverse solenoid 202.

Referring now to FIG. 4, depicted therein on a functional level is logic circuitry for inserting the delays in the signals for operating the reverse solenoid 202. Within the back-tack control circuit 204 a signal is generated on lead 208, in a manner to be described hereinafter, to indicate that the sewing system is in ZONE 2. It will be recalled that during ZONE 2 the reverse solenoid 202 is to be energized so that the sewing machine feeds in the reverse direction. Interposed between lead 208 and amplifier 206 is an OR gate 210 plus a delay element 212. The delay element 212 is arranged as a 40 millisecond "off" delay whereby when a high signal is applied to its input, a high signal immediately appears at its output, but when the high signal is removed from its input, the high signal does not disappear from its output until the expiration of the 40 millisecond delay period. Therefore, when a high signal appears on the lead 208 indicating that the machine should be in its ZONE 2, the reverse solenoid 202 is immediately energized. When the high signal is removed from the lead 208 indicating that the machine should no longer be in its ZONE 2, the delay element 212 maintains its high signal at its output to the OR gate 210 for an additional 40 milliseconds, thereby keeping the machine in a reverse mode of operation for this delay period. When a high signal appears on the lead 214 indicating that the machine is in its ZONE 4, the reverse solenoid 202 is energized for the entire period that the ZONE 4 signal is present on the lead 214. When a high ZONE 6 signal is applied to the lead 216, it must first pass through a 60 millisecond "on" delay element 218 before passing through the OR gate 210 to energize the reverse solenoid 202. Therefore, when the system goes into ZONE 6, the reverse solenoid 202 is not energized until 60 milliseconds after that transition.

Figure 5:
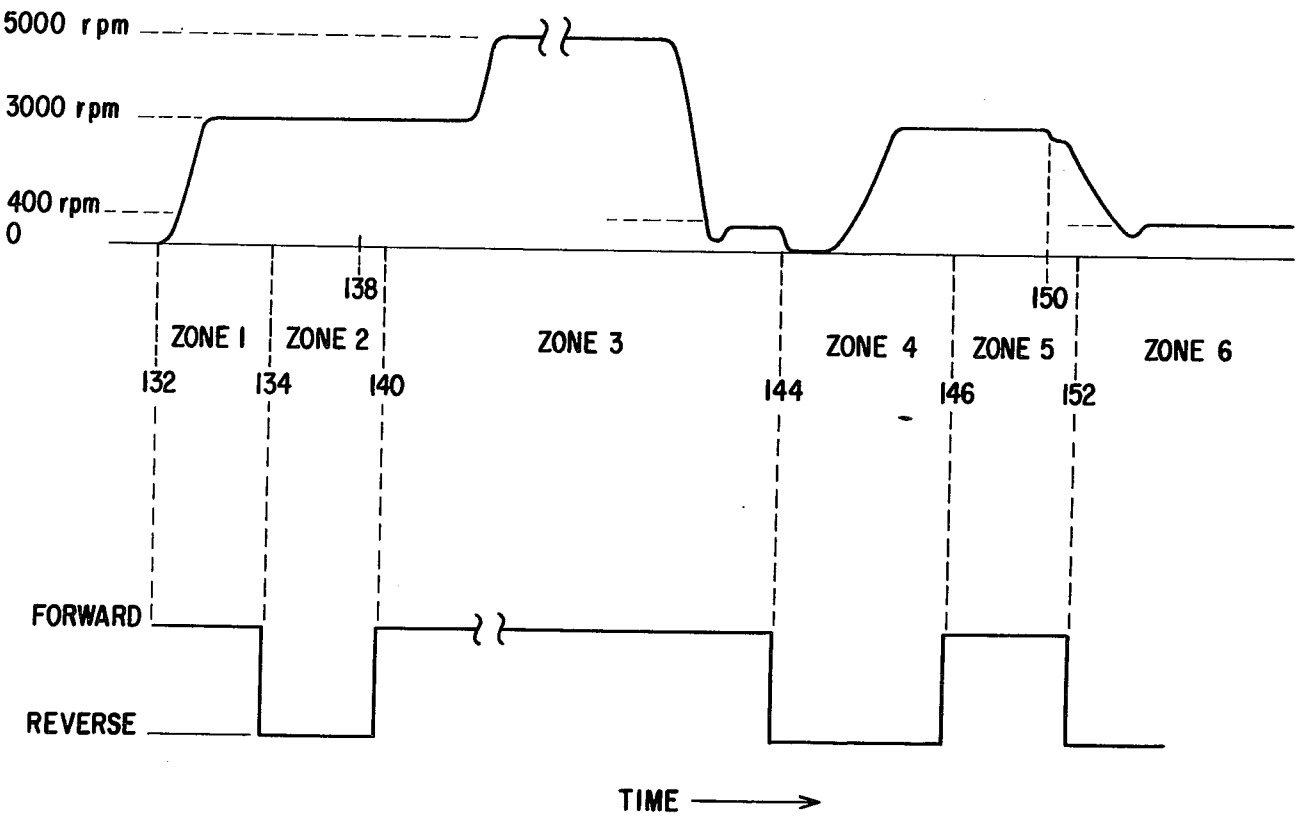
FIG. 5 shows timing charts of the sewing machine speed and direction when operating in accordance with the principles of this invention.

Referring now to FIG. 5, shown therein are timing charts illustrating the machine speed and the feed direction as functions of time. The upper curve in FIG. 5 illustrates the machine speed as a function of time and the lower curve in FIG. 5 illustrates the work feed direction as a function of time. The reference numerals in FIG. 5 correspond to the points in FIG. 2B. In ZONE 1, the machine is operating with the reverse solenoid deenergized and the machine accelerates from a standstill up to 3000 rpm, the back-tack speed. In ZONE 2, the reverse solenoid is energized and the machine maintains its speed of 3000 rpm. Although not readily discernable from the curve, the 40 millisecond delay is at the end of the ZONE 2 region. If this delay were not there, the areas under the speed curve for ZONE 1 and ZONE 2 would be equal, the area under the curve corresponding to the number of stitches. The ZONE 2 area is greater due to the additional delay. In ZONE 3, the reverse solenoid is not energized and the machine maintains a 3000 rpm speed for a sufficient time to stabilize, after which it accelerates to illustratively 5000 rpm. At the point 144 at the end of ZONE 3, the machine is brought to a halt by the operator reaching the end of the seam. The reverse solenoid is then energized and the machine goes into its last tack mode, beginning with ZONE 4. At the end of ZONE 4, at the point 146, the reverse solenoid is deenergized and the machine goes into ZONE 5. At the point 150, the last tack delay is added and the machine starts to decelerate for the trim operation. At the point 152, the reverse solenoid is energized and the machine continues its deceleration until it slows to a speed of 400 rpm, at which speed the trim operation can be effected.

DETAILED DESCRIPTION OF A PREFERRED EMBODIMENT

Figure 6A:
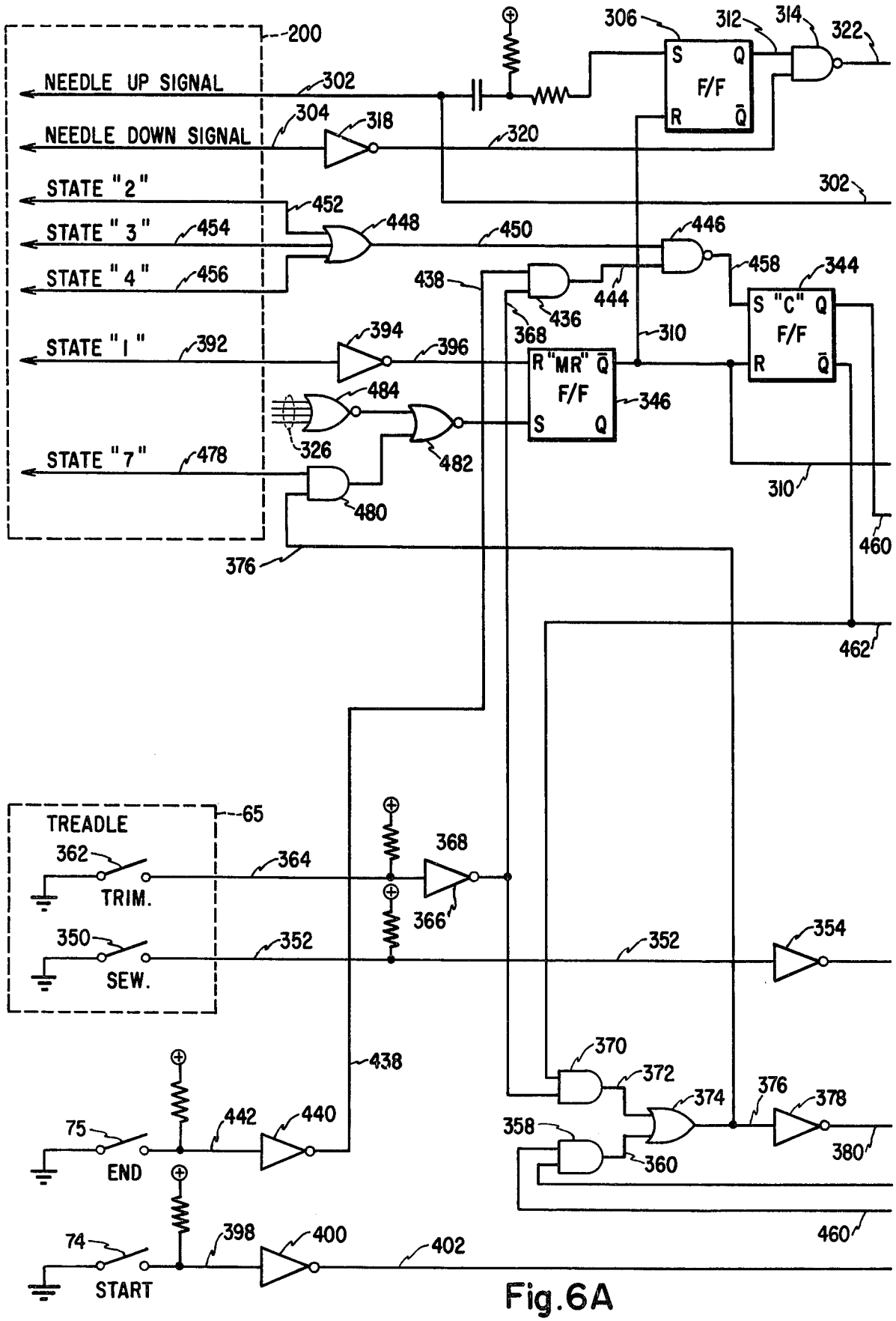
FIGS. 6A and 6B, with FIG. 6A placed to the left of FIG. 6B, depict a detailed logic schematic of circuitry embodying the principles of this invention.
Figure 6B:
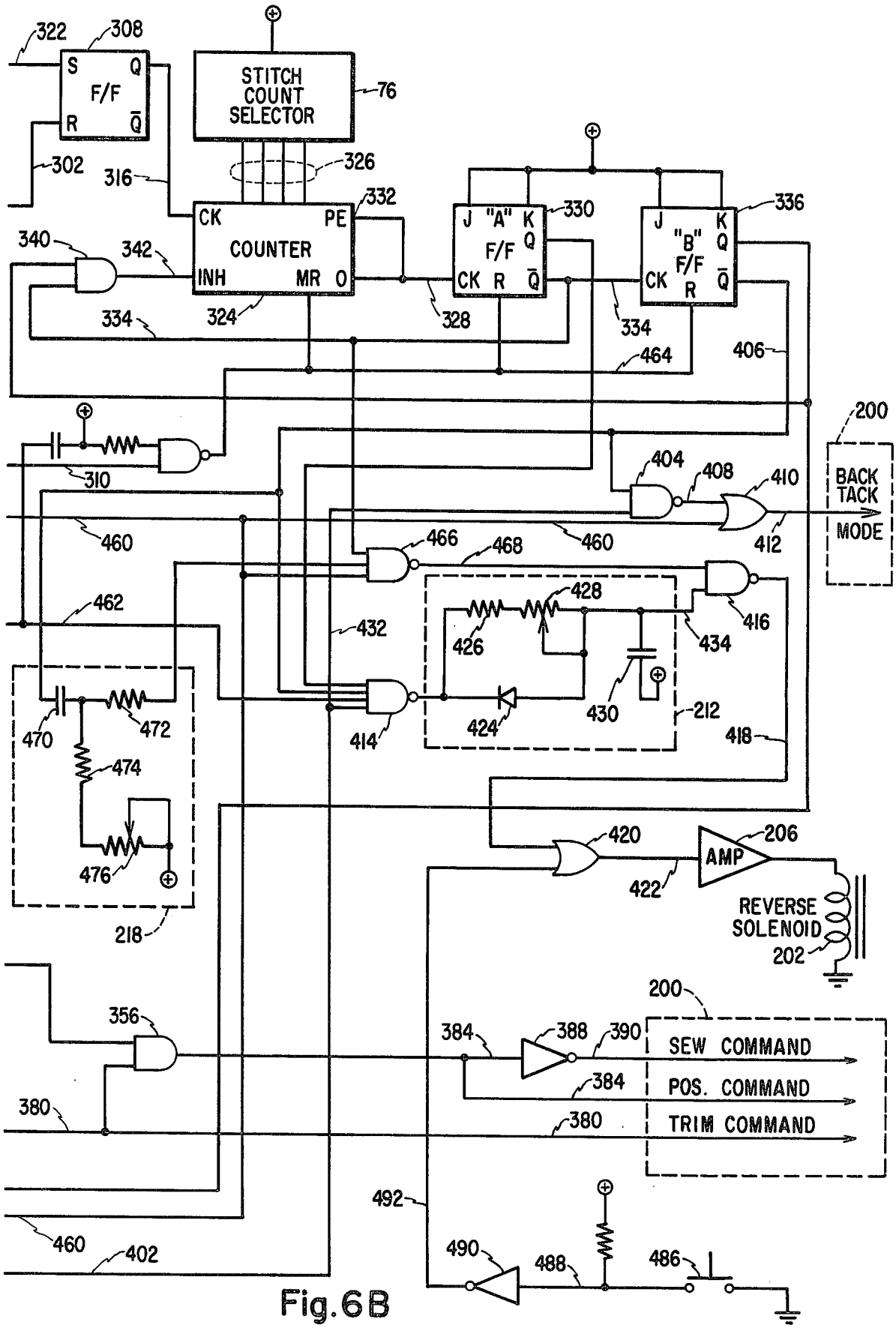

Referring now to FIGS. 6A and 6B, depicted therein is a detailed schematic diagram of exemplary logic circuitry for implementing the back-tack control circuit 204 (FIG. 3), which circuitry operates in accordance with the principles of this invention to implement the functioning of the sewing machine as described hereinabove. Prior to describing the operation of the circuitry in FIGS. 6A and 6B, at this point a brief description of the operation of the main machine control circuit 200 (FIG. 3) is appropriate. Generally, the main machine control circuit 200 defines different logic states and responds to inputs thereto to sequence through these states. The inputs to the main machine control circuit 200 are from the operator controlled foot treadle 65 and the back-tack control circuit 204. The main machine control circuit 200 provides signals to the back-tack control circuit 204 indicative of the state in which the main machine control circuit 200 is in. There are ten such states, states "0" through "9." State "0" is an idle state where the sewing machine is not in motion. When the operator toes the foot treadle 65 forward to the sew position, the logic switches to state "1." In state "1," a drive command signal is generated to the motor control system (not shown). When in state "1," the system sequences through events which cause the first back-tack to be formed assuming that the START switch 74 has been closed. As has been described hereinabove, the system sews forward for a predetermined number of stitches and then sews in reverse for the same predetermined number of stitches, this number being selected by the operator through the stitch count selector switch 76. The seam is then sewn in the forward direction. When the operator comes to the end of the seam, the foot treadle 65 is generally heeled to effect the trimming function. As the foot treadle is moved from the forward sew position to the rearward trim position, it passes through a neutral, or "position," position. The circuitry is designed so that the back-tack at the end of the seam does not begin until after the machine comes to a standstill. For example, if the operator heels the foot treadle 65 when the machine is operating at 6000 rpm nothing occurs immediately with the back-tack. When the main logic senses the heel position, it will apply a dynamic brake to the motor and sequence from state "1" to state "2." When in state "2," this indicates that the motor is decelerating. When the machines decelerates down to 400 rpm, the logic sequences to state "3" which turns off the dynamic brake. Immediately thereafter, the logic sequences to state "4" which is a slow speed running condition at 400 rpm. The machine will continue running at 400 rpm until the needle down position is sensed. When the needle down position is sensed, the machine will sequence to state "5" wherein a mechanical brake is applied. As will be described hereafter, the back-tack control circuit 204 is inhibited from operating during states "2," "3," and "4." To perform the last tack, the main machine control logic 200 switches to state "1" and the inhibit signal to the back-tack control circuit 204 is removed. Since the foot treadle 65 is in its heel position, this closes the trim switch and causes the last tack to begin, if the END switch 75 has been closed. When the back-tack control circuit 204 goes into the back-tack mode, it provides a signal indicative of same to the main machine control circuit 200. This signal causes the main machine control circuit to 200 to cause the motor control system (not shown) to use as a speed reference a fixed signal instead of the reference provided by depression of the foot treadle 65. This fixed reference will cause the machine to run at illustratively 3000 rpm. If the operator is sewing the work piece and desires to stop the machine without going into a trim sequence, the treadle 65 is shifted to its neutral position and is not heeled, in which case the main machine control circuit 200 goes to state "6." In this state, the machine is stopped in the needle down position. State "7" is the beginning of the trim sequence of the main logic. When the machine starts to trim, by definition all back-tacking is completed. States "8" and "9" are concerned with the trimming and shutting down of the machine and as such have no effect upon the operation of the back-tack control circuit 204.

Referring now specifically to FIGS. 6A and 6B, the circuitry depicted therein is responsive to signals applied thereto for sequentially changing its internal state and supplying output signals in accordance with its internal state. The internal state is determined by the states of three flip-flops, designated the "A" flip-flop, the "B" flip-flop and the "C" flip-flop. The states of the three flip-flops define the ZONES of the seam being sewn (FIG. 2B). The correspondence between the ZONES and the states of the three flip-flops is set forth in the following Table I:

TABLE I

| | A | B | C |
|---|---|---|---|
| ZONE 1 | 0 | 0 | 0 |
| ZONE 2 | 1 | 0 | 0 |
| ZONE 3 | 0 | 1 | 0 |
| ZONE 4 | 0 | 0 | 1 |
| ZONE 5 | 1 | 0 | 1 |
| ZONE 6 | 0 | 1 | 1 |

The back-tack control circuit 204 shown in FIGS. 6A and 6B is connected to receive from the main control circuit 200 needle up and needle down signals over the leads 302 and 304, respectively. As is conventional in the art, the needle up signal on the lead 302 is normally at a high logic voltage level and goes low when the needle 52 is within a relatively small range of its uppermost position. Similarly, the needle down signal on the lead 304 is normally high and goes low when the needle 52 is within a relatively small range of its lowermost position. These signals are generated in a conventional manner by sensors mounted on the main machine arm shaft (not shown). The needle up and needle down signals are utilized for generating stitch signals which are counted. For purposes of the present description, a "stitch" is defined as what occurs between successive needle penetrations. One way of counting stitches would be to count the number of times the needle down signal occurs. However, the first needle down position must be ignored because the first stitch is not completed until the occurrence of the second needle penetration. Therefore, the stitch signals are generated by the occurrence of a needle down signal following a needle up signal after the occurrence of the first needle down signal. To accomplish this result, two flip-flops, 306 and 308, are utilized. As will be described hereinafter, when the sewing machine is first turned on, a low signal on the lead 310 resets flip-flop 306. The first needle up signal on the lead 302 sets the flip-flop 306 and resets the flip-flop 308. With the flip-flop 306 set, a high signal appears on the lead 312, one of the two inputs to the NAND gate 314. With the flip-flop 308 reset, a low signal appears at its Q output on lead 316. When the needle down signal occurs on the lead 304, the low going pulse is inverted by the inverter 318 to provide a high going pulse on the lead 320, the second input to the NAND gate 314. This causes a low going pulse to appear on the output lead 322 of the NAND gate 314, thereby setting the flip-flop 308, providing a high signal at its Q output on the lead 316. The next needle up signal on the lead 302 will have no effect on the flip-flop 306 but will reset the flip-flop 308, causing its Q output on the lead 316 to go low again. Similarly, the following needle down signal on the lead 304 will set the flip-flop 308. Thus, a train of stitch signals are generated on the lead 316, which is an input to the counter 324.

The counter 324 is a conventional "divide by N circuit," wherein N is programmable. The stitch count selector switch 76 is coupled to the counter 324 to provide a binary coded decimal (BCD) representation of the selected number of stitches to be sewn for the first and last tacks. The BCD representation of the selected number of stitches is coupled from the stitch count selector switch 76 to the counter 324 over the leads 326. The counter 324 operates in a conventional manner in response to the stitch signals on the lead 316 to count down from the number set into the counter 324 over the leads 326. When the count reaches zero, a signal is applied to the lead 328. The signal on the lead 328 serves two functions. First, it toggles the "A" flip-flop 330, and second it is applied to the preset enable input 332 of the counter 324 to load into counter 324 the BCD representation of the selected number of stitches from the leads 326. The "A" flip-flop 330 is a conventional JK flip-flop connected as a toggle flip-flop with its J and K inputs connected to a positive voltage supply. Therefore, the state of the "A" flip-flop 330 is changed whenever the counter 324 indicates that the selected number of stitches has been sewn. The $\overline{Q}$ output of the "A" flip-flop 330 on lead 334 is connected to the clock input of the "B" flip-flop 336, also a JK type flip-flop connected as a toggle flip-flop. Therefore, on alternate changes of state of the "A" flip-flop 330, the "B" flip-flop 336 is caused to change state. The foregoing will be apparent from a study of Table I and FIG. 2B. In ZONE 1, where the first tack is starting, both the "A" flip-flop 330 and the "B" flip-flop 336 are in their zero states. After the desired number of stitches for the tack have been completed, the state of the "A" flip-flop 330 is changed and the system moves to ZONE 2. The same number of stitches are counted in ZONE 2 and at the end of that number of stitches, the state of the "A" flip-flop 330 is again changed. This second change causes the state of the "B" flip-flop 336 to likewise change and the system moves to ZONE 3. In ZONE 3, the states of the "A" flip-flop 330 and the "B" flip-flop 336 cause a signal to appear at the output of AND gate 340, which is coupled to the inhibit input 342 of the counter 324. At the end of ZONE 3, in a manner to be described hereinafter, the "A" flip-flop 330 and the "B" flip-flop 336 are reset and the stitches are again counted for ZONES 4 and 5.

Now that the manner of counting the stitches has been described, the operation of the remainder of the circuitry depicted in FIGS. 6A and 6B as it relates to input signals defining the state of the main machine control circuit 200 as well as the positioning of the foot treadle 65 and the START and END switches 74 and 75, respectively, as well as the signals provided to the main machine control circuit 200 and the reverse solenoid 202 will now be described in detail. In addition to the "A" flip-flop 330 and the "B" flip-flop 336, the circuitry shown in FIGS. 6A and 6B also includes a "C" flip-flop 344 and a "master reset" (MR) flip-flop 346. When power is initially applied to the sewing machine system through the operation of switch 73, the "A," "B," "C" and master reset flip-flops 330, 336, 344 and 346, respectively, are all in their zero, or reset, states. The operator then selectively closes the switches 74 and 75 depending upon whether only a first tack, only a last tack, both a first tack and a last tack, or no tack is desired. If there is to be a back-tack operation, stitch count selector switch 76 is utilized to set the desired number of stitches in the tack into the system. Now that the system has been programmed, by the selective operation of switches 74, 75 and 76, the operator may place a work piece under the presser foot 53 and begin to sew. For purposes of illustrating the operation of the system, it will be assumed that the operator desires both a first tack and a last tack and hence the switches 74 and 75 are both closed. If either of these two switches were opened, the corresponding tack would not be sewn.

To initiate the sewing operation, the operator toes the foot treadle 65 which causes the SEW switch 350 to be closed. With the SEW switch 350 closed, a low signal appears on the lead 352. This low signal is inverted by the inverter 354 and applied to one input of the AND gate 356 as a high signal. Since the "B" flip-flop 336 and the "C" flip-flop 344 are both in their "0" states, the output of the AND gate 358 on the lead 360 is low. Since the TRIM switch 362 in the foot treadle 65 is opened, a high signal appears on the lead 364. This signal is inverted by the inverter 366 to a low signal on the lead 368. Therefore, the output of the AND gate 370 on the lead 372 is low. Since both inputs to the OR gate 374 are low, there is a low signal on the lead 376. This low signal is inverted by the inverter 378 to provide a high signal on the lead 380. The high signal on the lead 380 is the second input to the AND gate 356, the other input being the high output of the inverter 354, as previously described. Therefore, the output of the AND gate 356 on the lead 384 is high. This high signal on the lead 384 is inverted by the inverter 388 to provide a low SEW COMMAND signal on the lead 390 to the main machine control circuit 200. Upon receipt of the SEW COMMAND signal on the lead 390, the main machine control circuit 200 internally sequences from its state "0" to its state "1." When in state "1," the main machine control circuit 200 provides a high signal on the lead 392. This high signal on the lead 392 is inverted by the inverter 394 to provide a low signal on the lead 396. The low signal on the lead 396 causes the master reset flip-flop 346 to be reset, providing a high signal on the lead 310. This high signal on the lead 310 allows the first needle up signal on the lead 302 to set the flip-flop 306 and enable stitch counting to take place. Since the START switch 74 is closed, a low signal is applied to the lead 398. This low signal is inverted by the inverter 400 to a high signal on the lead 402. The lead 402 is one input of the AND gate 404. The outer input of the AND gate 404 is the $\overline{Q}$ output of the "B" flip-flop 336 on the lead 406. Since the "B" flip-flop 336 is in its "0" state, its $\overline{Q}$ output on the lead 406 is high. With two high inputs, the output of the AND gate 404 on the lead 408 is high. This high signal on the lead 408 passes through the OR gate 410 to provide a high signal on the back-tack mode lead 412 to the main machine control circuit 200. The main machine control circuit 200 responds to a high signal on the lead 412 to go into its back-tack mode. In this mode, the main machine control circuit 200 causes the motor speed control (not shown) to operate at back-tack speed, illustratively 3000 rpm.

After the programmed number of stitches have been sewn, the "A" flip-flop 330 changes state. The output of the NAND gate 414 goes low, causing the output of the NAND gate 416 on the lead 418 to go high. This causes the output of the OR gate 420 on lead 422 to go high. This high signal on the lead 422 is amplified by the amplifier 206 to cause the energization of the reverse solenoid 202, which causes stitching to begin in the reverse direction. The system is now in ZONE 2 and the programmed number of back-tack stitches are again counted. When the predetermined programmed count is reached, the state of the "A" flip-flop 330 is changed. This causes the state of the "B" flip-flop 336 to also change so that the "A" flip-flop is in its "0" state and the "B" flip-flop is in its "1" state. The change of state of the "B" flip-flop 336 causes the signal on the lead 406 to go low which results in the back-tack mode signal on the lead 412 going low so that the main machine control circuit 202 reverts to its sewing state, while still remaining in its state "1." With the change of state of the "A" and "B" flip-flops 330 and 336, the output of the NAND gate 414 goes high. This transition from low to high is delayed by the delay circuit 212 which comprises a diode 424, a fixed resistor 426, a variable resistor 428 and a capacitor 430. The component values are chosen so that a positive going signal on the lead 432 is delayed from appearing on the lead 434 for a period of 40 milliseconds. On the other hand, due to the action of the diode 424, a low going signal on lead 432 immediately appears on lead 433. The variable resistor 428 is provided for factory adjustment to compensate for component tolerance variations. After the 40 millisecond delay of the positive going signal on the lead 432, the output of the NAND gate 416 on the lead 418 goes low. This causes the reverse solenoid 202 to be deenergized. The first tack has now been completed.

The main machine control circuit 200 is still in its state "1" while the back-tack control circuit 204 is operating in ZONE 3. The speed of sewing is controlled in a conventional manner by the depression of the foot treadle 65 and cintinues in the forward direction until the operator reaches the end of the seam and heels the foot treadle 65. Heeling of the foot treadle 65 opens the SEW switch 350, causing the high signal to appear on the lead 352. This high signal is inverted by the inverter 354 and applied as a low signal to the input of the AND gate 356, which causes the output of the AND gate 356 on the lead 384 to go low and consequently a high signal on the lead 390. This removes the SEW COMMAND signal on the lead 390 to the main machine control circuit 200 and instead places a POSITION COMMAND signal on the lead 384 to the main machine control circuit 200. Upon receipt of the POSITION COMMAND signal on the lead 384, the main machine control circuit 200 sequences into its state "2" and dynamically brakes the motor. It then sequences to state "3" and turns off the brake; then to state "4" and operates the motor at a speed of 400 rpm until a needle down position is sensed, at which time it sequences into its state "5." In its state "5," a mechanical brake is applied to the motor and the sewing machine comes to a halt. The sewing is now at point 144 (FIG. 2B) with the machine at a standstill. The main machine control circuit 200 then sequences into its state "6" waiting for the last tack or trim command.

When the operator heeled the foot treadle 65, the TRIM switch 362 was closed, applying a ground to lead 364. The inverter 366 then applied a high signal to the lead 368. This high signal on the lead 368 is one of the inputs to the AND gate 436. The other input to the AND gate 436 is on the lead 438, the output of the inverter 440. The input to the converter 440 on the lead 442 is controlled by the state of the END switch 75. It will be recalled that for purposes of illustration the END switch 75 has been closed since a last tack is desired. Therefore, a low signal is on the lead 442 and consequently a high signal is on the lead 438. Thus, both inputs to the AND gate 436 are high, putting a high signal on the lead 444. The lead 444 is one input to the NAND gate 446. The other input to the NAND gate 446 is the output of the NOR gate 448 on the lead 450. The inputs to the NOR gate 448 are the leads 452, 454 and 456, which have applied thereto signals indicative of states "2," "3," and "4," respectively, of the main machine control circuit 200. While the sewing machine was being brought to a standstill, the main machine control was being brought to a standstill, the main machine control circuit 200 sequenced through states "2," "3," and "4" and therefore, during this sequence, the leads 452, 454 and 456 were sequentially high. Therefore, the output of the NOR gate 448 on the lead 450 was low. However, as soon as the main machine control circuit 200 sequences into its state "5," the signal on the lead 450 goes high, causing the NAND gate 446 to apply a low signal on its output lead 458, which sets the "C" flip-flop 344. With the "C" flip-flop 344 set, its Q output on the lead 460 goes high, which high signal on the lead 460 passes through the OR gate 410 to apply a high signal to the lead 412. This signal on the lead 412 is the back-tack mode signal to the main machine control circuit 200 which causes the main machine control circuit 200 to control the motor control system to use the back-tack speed as the speed reference for the main drive motor.

In the meantime, when the foot treadle 65 was heeled and the TRIM switch 362 was closed, a high signal was applied to the lead 368. This high signal on the lead 368 in one input to the AND gate 370. The other input to the AND gate 370 is the $\overline{Q}$ output of the "C" flip-flop 344 on the lead 462. It will be recalled that during the time that the main control circuit 200 was sequencing through its states "2," "3" and "4," the "C" flip-flop 344 was still in its reset state. Therefore, during this time there was a high signal on the lead 462. Therefore, the output of the AND gate 370 on the lead 372 was high and a TRIM COMMAND signal was applied on the lead 380 to the main machine control circuit 200. However, the main machine control circuit 200 ignores this signal until it reaches point 144, when the machine is at a standstill. However, at this time, it will be recalled that the "C" flip-flop 344 was set, thereby removing the high signal from the lead 462 and thus the TRIM COMMAND signal on the lead 380 is likewise removed.

When the "C" flip-flop 344 is set because the main machine control circuit sequences into its state "5" and the inhibiting signal is removed from the lead 450, the counter 324, the "A" flip-flop 330 and the "B" flip-flop 336 are reset via the lead 464. Since the "A" and "B" flip-flops 330 and 336 are in their reset states and the "C" flip-flop 344 is in its set state, all the inputs to the NAND gate 466 are high. Therefore, the output of the NAND gate 466 on the lead 468 is low causing the output of the NAND gate 416 on the lead 418 to go high, causing a high signal to appear on the lead 422 which causes the reverse solenoid 202 to be energized. The system is now in its ZONE 4 with sewing proceeding in the reverse direction and the stitches being counted. When the desired number of stitches for the first portion of the last tack have been counted, the "A" flip-flop 330 changes state, and consequently the reverse solenoid 202 is deenergized. The system is now in its ZONE 5. When the desired number of stitches have again been counted, the "A" and "B" flip-flops 330 and 336 are toggled. However, the positive going signal on the $\overline{Q}$ output of the "B" flip-flop 336, lead 406, is delayed by the delay circuit 218 from affecting the operation of NAND gate 466. The delay circuit 218 comprises a capacitor 470, fixed resistors 472 and 474, and a variable resistor 476. Resistor 476 is factory adjustable to compensate for component tolerance variations so that the delay circuit 218 provides a 60 millisecond delay on the positive going transition occurring on the lead 406. Therefore, after the 60 millisecond delay, the reverse solenoid 202 is energized. In the meantime, when the "B" flip-flop 336 changes state, with both the "B" and "C" flip-flops in their set states, both input to the AND gate 358 are high, causing a high signal to appear on the lead 360. This high signal on the lead 360 is transmitted through the OR gate 374 to the lead 376. The high signal on the lead 376 is inverted by the inverter 378 to provide a low signal on the lead 380, the TRIM COMMAND signal to the main machine control circuit 200. The main machine control circuit 200 then sequences into its state "7" to perform the trimming operation. When in state "7," the main machine control circuit 200 applies a high signal on the lead 478. This high signal on the lead 478 coupled with a high signal on the lead 376 passes through the AND gate 480 to one input of the NOR gate 482. The output of the NOR gate 482 goes low, setting the master reset flip-flop 346. This causes the "A" flip-flop 330, the "B" flip-flop 336, the "C" flip-flop 344 and the counter 324 to all be reset, thereby terminating the operation of the system. The other input to the NOR gate 482 is the output of the NOR gate 484 which has as its inputs the outputs from the stitch count selector switch 76 on the leads 326. If for some reason the stitch count selector switch 76 is set at zero, all the inputs on lead 326 would be low. The output of the NOR gate 484 would then be high, causing the output of the NOR gate 482 to be high keeping the system reset without either a first tack or a last tack.

If during the running portion of the seam (ZONE 3), the operator desires to provide a tack, the REVERSE SWITCH 486 is closed, providing a low signal on the lead 488. This low signal is inverted by the inverter 490 to provide a high signal on the lead 492. This high signal passes through the OR gate 420 to cause the reverse solenoid 202 to be energized during the time that the REVERSE SWITCH 486 is closed.

Accordingly, there has been described an automatic back-tack system for a high speed sewing machine wherein balanced back-tack stitching is attained. It is understood that the above-described arrangement is merely illustrative of the application of the principles of this invention. Numerous other arrangements may be derived by those skilled in the art without departing from the spirit and scope of this invention, as defined by the appended claims. For example, although the illustrative embodiment described herein includes fixed delay elements, this invention broadly contemplates changing the timing of the reverse signal. This changing may be accomplished other than by inserting a fixed delay as, for instance, by varying the stitch count in accordance with the machine speed.

Having thus set forth the nature of this invention, what is claimed herein is:

1. An automatic back-tack system for a sewing machine having a sewing needle and a reversible work feed mechanism, said sewing needle and said work feed mechanism operating in synchronism to form stitches in a seam having a leading end and a trailing end in a work piece, stitches forming a back-tack being selectively sewn at at least one end of said seam, the back-tack stitches including a first portion formed by stitching in a first direction and a second portion formed by stitching in a second direction opposite said first direction, said back-tack system comprising:

means for generating a stitch signal in response to each penetration of said sewing needle;

counting means responsive to said stitch signals for counting stitches within each back-tack portion and providing a count signal when the stitch count reaches a predetermined number;

means responsive to said count signal for providing a reverse signal to reverse said work feeding mechanism; and means for changing the timing between said count signal and said reverse signal a respective predetermined time interval during each back-tack second portion.

2. The system according to claim 1 wherein said counting means includes means for selectively varying said predetermined number.

3. The system according to claim 1 further including:

first switch means manually operable to a first position for conditioning said system to form back-tack stitches at the leading end of said seam and operable to a second position for conditioning said system not to form back-tack stitches at the leading end of said seam; and second switch means manually operable to a first position for conditioning said system to form back-tack stitches at the trailing end of said seam and operable to a second position for conditioning said system not to form back-tack stitches at the trailing end of said seam.

4. The system according to claim 1 wherein said predetermined time intervals are independent of machine speed.

5. The system according to claim 4 wherein the predetermined time interval for the leading end back-tack is a 40 milliseconds delay and the predetermined time interval for the trailing end back-tack is a 60 milliseconds delay.

6. The system according to claim 1 wherein said stitch signal generating means includes means for initiating said stitch signals with the second penetration of said sewing needle.

7. In a sewing machine having a sewing needle and a reversible work feed mechanism, said sewing needle and said work feed mechanism operating in synchronism to form stitches in a seam having a leading end and a trailing end in a work piece, a method for selectively forming back-tack stitches at at least one end of said seam, the back-tack stitches including a first portion formed by stitching in a first direction and a second portion formed by stitching in a second direction opposite said first direction, said method comprising the steps of:

(a) counting stitches within each first back-tack portion;

(b) reversing said work feed mechanism after counting a predetermined number of stitches within each first back-tack portion;

(c) counting stitches within each second back-tack portion; and (d) reversing said work feed mechanism a predetermined respective time interval after counting said predetermined number of stitches in each back-tack second portion.

8. The method according to claim 7 wherein step (d) includes the steps of:

(e) timing 40 milliseconds for the predetermined time interval during the leading end back-tack; and (f) timing 60 milliseconds for the predetermined time interval during the trailing end back-tack.

9. In a method of operating a sewing machine to form back-tack stitches at at least one of the leading and trailing ends of a seam wherein the back-tack at each end of the seam includes a first portion formed by stitching in a first direction and a second portion formed by stitching in a second direction, and the method includes the steps of counting stitches within the back-tack first and second portions and reversing the sewing machine work feed mechanism after counting a predetermined number of stitches, the improvement comprising;

delaying by a predetermined time interval the work feed mechanism reversal after counting the predetermined number of stitches in the back-tack second portion.

* * * * *